US010428482B2

(12) United States Patent
Recher

(10) Patent No.: US 10,428,482 B2
(45) Date of Patent: Oct. 1, 2019

(54) ARRANGEMENT FOR PROVIDING A PULSING COMPRESSIVE FORCE

(71) Applicant: Ammann Schweiz AG, Langenthal (CH)

(72) Inventor: Lukas Recher, Ziefen (CH)

(73) Assignee: AMMANN SCHWEIZ AG, Langenthal (CH)

( * ) Notice: Subject to any disclaimer, the term of this patent is extended or adjusted under 35 U.S.C. 154(b) by 0 days.

(21) Appl. No.: 15/780,316

(22) PCT Filed: Dec. 3, 2015

(86) PCT No.: PCT/CH2015/000178

§ 371 (c)(1),
(2) Date: May 31, 2018

(87) PCT Pub. No.: WO2017/091912

PCT Pub. Date: Jun. 8, 2017

(65) Prior Publication Data

US 2018/0355572 A1 Dec. 13, 2018

(51) Int. Cl.
*E02D 3/00* (2006.01)
*E02D 3/074* (2006.01)

(52) U.S. Cl.
CPC ..... *E02D 3/074* (2013.01)

(58) Field of Classification Search
CPC ..... E02D 3/074
USPC ..... 404/72, 113, 117; 172/40; 366/108; 81/463; 74/61, 87
See application file for complete search history.

(56) References Cited

U.S. PATENT DOCUMENTS

2004/0009039 A1* 1/2004 Corcoran ..... E01C 19/286 404/117
2013/0259570 A1* 10/2013 Thiesse ..... E01C 19/286 404/75

FOREIGN PATENT DOCUMENTS

DE 20 2004 014 585 U1 1/2006
DE 20 2009 004 302 U1 11/2009
WO 2011/127611 A2 10/2011

OTHER PUBLICATIONS

International Search Report for International Application No. PCT/CH2015/000178 dated Aug. 3, 2016.

* cited by examiner

*Primary Examiner* — Raymond W Addie
(74) *Attorney, Agent, or Firm* — McCormick, Paulding & Huber LLP

(57) ABSTRACT

An apparatus for compaction of soil and asphalt includes a first mass, such as a compaction drum, or vibrating plate, a second mass configured to oscillate vertically and an unbalanced shaft configured to vibrate the first and second masses. Wherein removable masses can be added and removed from the second mass, in order to enable resonance vibration of the first and second masses, thereby doubling and even tripling the compaction forces applied to the surface being compacted.

33 Claims, 14 Drawing Sheets

ARRANGEMENT FOR PROVIDING A PULSING COMPRESSIVE FORCE

CROSS-REFERENCE TO RELATED APPLICATION

This application is a National Stage application of International Patent Application No. PCT/CH2015/000178, filed on Dec. 3, 2015, the disclosure of which is hereby incorporated by reference in its entirety.

TECHNICAL FIELD

The invention concerns an arrangement for providing a pulsing compressive force, a soil compaction device comprising such an arrangement, the use of the soil compaction device for the compaction of asphalt as well as a method of operating such an arrangement or such a soil compaction device according to the preambles of the independent claims.

BACKGROUND ART

In the field of soil compaction, compaction devices are used in which a soil contact surface, which in most cases is formed by a flat plate or a roller body (drum), by means of an unbalance exciter is caused to vibrate, thereby exerting a pulsing compressive force onto the soil.

By means of this it is possible to achieve with simple compaction devices in the contact operation (permanent soil contact) soil compaction forces which temporarily amount to 2-times of the weight of the device. In case an occasional taking-off of the soil contact surface is permitted, even soil compaction forces can be achieved which temporarily amount to 2.5-times of the weight of the device.

In more sophisticated compaction devices, which function according to the damper principle, the plate or roller body is via a spring-damper-system connected with an damper mass arranged above it, which mass via the spring-damper-system is also excited in order to vibrate. In case the erasor mass is vibrating in phase with the same frequency (1:1 resonance) or with half of the frequency (2:1 resonance) of the plate or the roller body, with this machine concept soil compaction forces can be achieved which amount to more than 3-times of the weight of the device, if the taking-off of the soil contact surface from the ground is permitted. Such soil compaction surfaces are know e.g. from WO 2011/127611 A2.

In particular when compacting asphalt, a taking-off of the soil contact surface from the ground is however inadmissible, since such a compaction operation would result in a fragmenting of the mineral material at the asphalt surface, what at all costs must be avoided. Nevertheless, also here there exists a permanent desire for machines having increased compaction power.

SUMMARY OF THE INVENTION

Therefore, it is the objective of the invention to provide a machine concept by means of which in contact operation significantly higher compaction power can be achieved as to date.

This objective is achieved by the present invention.

Accordingly, a first aspect of the invention concerns an arrangement for providing a pulsing compressive force. The arrangement comprises a first mass, which provides a contact surface for transferring the pulsing compressive force onto a physicalness, e.g. onto a ground surface to be compacted. Further, the arrangement comprises a second mass, which via a first spring-damper-system is coupled with the first mass to form a first vibrating system. Furthermore, the arrangement comprises an unbalance exciter, by means of which this first vibrating system can be excited to vibrate, preferrably to vibrate in resonance.

In the static state of the first vibrating system, i.e. when the system is at rest, the second mass exerts a static force on the first mass via the first spring-damper-system in a first direction. Thereby, the coupling of the first mass and the second mass via the first spring-damper-system is realized in such a way that via the first spring-damper-system in the intended operation no forces can be transferred from the first mass in the first direction to the second mass and no forces can be transferred from the second mass in a second direction, which is opposite to the first direction, to the first mass. In addition, the arrangement is constructionally designed such that this so called "one-sided coupling" of the two masses via the first spring-damper-system in the intended operation can be temporarily suspended, preferrably periodically (i.e. repeatedly in periodic intervals), by a vibratory movement of the second mass in the second direction, and the second mass can then execute a part of its oscillation path in the uncoupled state, before the coupling of the masses via the first spring-damper-system is then, following a reversal in direction of the vibratory movement of the second mass, in particular abruptly, re-established. The suspension and guidance, respectively, of the second mass is thus designed in such a way that in the intended operation it can execute an oscillation path which enables the before mentioned temporary decoupling.

It has shown that with such arrangements according to the invention there can be provided soil compaction devices, which achieve in the contact operation (permanent ground contact) soil compaction forces which temporarily are significantly higher than 2-times of the weight of the device.

In a preferred embodiment of the arrangement according to the invention, the first mass and the second mass are coupled in such way with the first spring-damper-system that the second mass, when vibrating in the intended operation, can temporarily decouple from the first spring-damper-system through a movement in the second direction and in the decoupled state can execute a part of its oscillation path, before it then, after a reversal in direction of movement, again, in particularly abruptly, couples to the first spring-damper-system, while the first mass is fixedly or in a manner that in the intended operation it cannot be decoupled, respectively, connected with the first spring-damper-system and at the same time forms a part of this first mass.

In another preferred embodiment the analogous opposite coupling situation is envisaged, i.e. the first mass is temporarily decoupled from the first spring-damper-system.

Depending on the structural design of the arrangement either variant may be more preferable.

In a further preferred embodiment of the arrangement, in the static state of the first vibrating system, the second mass exerts a static compressive force on the first mass via the first spring-damper-system. At the same time, the first mass and the second mass are coupled to one another via the first spring-damper-system in such a way that via the first spring-damper-system exclusively compressive forces can be transferred between the two masses.

In another preferred embodiment of the arrangement, in the static state of the first vibrating system, the second mass exerts a static tensile force on the first mass via the first spring-damper-system. At the same time, the first mass and the second mass are coupled to one another via the first spring-damper-system in such a way that via the first spring-damper-system exclusively tensile forces can be transferred between the two masses.

Depending on the structural design of the arrangement either variant may be more preferable.

In still a further preferred embodiment of the arrangement, the static force exerted in the static state of the first vibrating system by the second mass via the first spring-damper-system on the first mass substantially runs in the direction of gravity. Such arrangements according to the invention are especially suitable for soil compaction devices and ramming devices.

In particular when using the arrangement according to the invention in soil compaction devices it is further preferred that the static force exerted in the static state of the first vibrating system by the second mass via the first spring-damper-system on the first mass completely or in part is generated by the weight of the second mass.

Alternatively or additionally it is envisaged that the static force exerted in the static state of the first vibrating system by the second mass via the first spring-damper-system on the first mass completely or in part is generated by a force charged to the second mass. In particular in applications where the first direction runs inclined or even horizontal, as e.g. in case of a use of the arrangement according to the invention in a horizontally oriented drilling machine for generating a pulsing contact pressing force of the drill onto the area of machining, this embodiment is advantageous or even necessary.

In that case it is envisaged in a preferred variant that the force charged to the second mass is charged to the mass via one or several spring elements. By this, the vibration behaviour of the second mass can selectively be adjusted in such embodiments.

In doing so in a preferred embodiment of the last mentioned variant it is further envisaged that the spring element or the spring elements are connected with the first mass in such a way that in the static state of the first vibrating system via this or these spring elements a force is transferred to the first mass which acts in the second direction.

In still a further preferred embodiment of the arrangement according to the first aspect of the invention the first mass and the second mass are coupled to one another via a further spring-damper-system. Preferably, the modulus of resilience and/or the damping of the further spring-damper-system is smaller than the modulus of resilience and/or the damping of the first spring-damper-system.

In that case it is further preferred in a first variant of this embodiment of the arrangement that the first mass and the second mass are coupled to one another via the further spring-damper-system in such a way that between the further spring-damper-system and the two masses, forces can be transferred in the first direction and in the second direction. In other words the further spring-damper-system in this variant couples the two masses both-sided, i.e. such that both tensile forces and compressive forces can be transferred between the masses.

In a second variant of this embodiment of the arrangement, the first mass and the second mass are coupled to one another via the further spring-damper-system in such a way that via the further spring-damper-system from the second mass no forces can be transferred in the first direction to the first mass and from the first mass no forces can be transferred in the second direction to the second mass. In other words the further spring-damper-system in this second variant couples the two masses thus one-sided, such that merely either tensile forces or compressive forces can be transferred between the masses. In that case the arrangement is designed such that this so called "one-sided coupling" of the two masses via the further spring-damper-system in the intended operation can be temporarily suspended, preferably periodically, by a vibratory movement of the second mass in the first direction, and the second mass then in the uncoupled state can execute a part of its oscillation path, before the coupling of the masses via the further spring-damper-system is then, after a reversal in direction of the vibratory movement of the second mass, in particular abruptly, re-established.

In the before mentioned embodiments of the arrangement, in case that the static force exerted in the static state of the first vibrating system on the first mass completely or in part is generated by one or several spring elements charging the second mass, it is preferred that this or these spring elements are part of the further spring-damper-system.

In still a further preferred embodiment, the arrangement according to the first aspect of the invention comprises a third mass, which via a second spring-damper-system is coupled with the first mass to form a second vibrating system and/or which via a third spring-damper-system is coupled with the second mass to form a third vibrating system. Depending on the configuration and tuning of the masses and spring-damper-systems of the arrangement as well as depending on the excitation of same by means of the unbalance exciter, this third mass can e.g. serve as "resting pole", which practically executes no vibratory movement and is suitable for arranging drive motors, controls and control elements thereon and in case the first direction is vertically oriented additionally forms a load in this direction, or can also serve as "damper mass", which, in particular in phase, vibrates with the first mass, in particular with the frequency of oscillation of the first mass or with the half or a third of the frequency of oscillation of the first mass, and thereby additionally contributes a part to the pulsing compressive force in the first direction.

In that case in a preferred variant it is envisaged that the third mass and the first mass are coupled with each other via a second spring-damper-system in such a manner that between the second spring-damper-system and the two masses forces can be transferred both in the first direction and in the second direction. In other words the second spring-damper-system in this variant couples these two masses thus both-sided to each other, i.e. such that both tensile forces and compressive forces can be transferred between these masses.

Alternatively or additionally it is envisaged that the third mass and the second mass via a third spring-damper-system are coupled with each other in the before described manner.

In that case in a first preferred variant, the coupling of the third mass and the second mass is such that between the third spring-damper-system and these two masses both forces in the first direction and in the second direction can be transferred, thus these two masses are both-sided coupled, so that both tensile forces and compressive forces can be transferred between these masses.

In a second preferred variant, the third mass and the second mass are coupled with each other via the third spring-damper-system in such a manner that via the third spring-damper-system no forces can be transferred from the second mass in the first direction to the third mass and no forces can be transferred from the third mass in the second direction to the second mass. In other words the third spring-damper-system in this variant couples these two masses thus one-sided with each other, such that merely either tensile forces or compressive forces can be transferred between these masses. In that case the arrangement is designed such that this so called "one-sided coupling" of the two masses via the third spring-damper-system can be temporarily suspended during the intended operation, preferable periodically, by a vibratory movement of the second mass in the first direction and the second mass then in the uncoupled state can execute a part of its oscillation path, before the coupling of the masses via the third spring-damper-system is then, after a reversal in direction of the vibratory movement of the second mass has taken place, in particular abruptly, re-established.

Preferrably, the vibrating systems of the arrangement according to the invention are tuned or are tunable such that, when in the intended operation of the arrangement the first vibrating system (first mass, first spring-damper-system, second mass) is vibrating, preferrably in resonance, the second mass vibrates in phase with the first mass, in particular with the frequency of oscillation of the first mass or with half or a third of the frequency of oscillation of the first mass. By this it becomes possible to generate particular huge pulsing compressive forces.

Also it is envisaged in preferred embodiments of the arrangement, in which the arrangement comprises a third mass which is coupled with the first mass via a second spring-damper-system to form a second vibrating system and/or which is coupled with the second mass via a third spring-damper-system to form a third vibrating system, that the vibrating systems of the arrangement are tuned or are tunable such that when in the intended operation of the arrangement the first vibrating system (first mass, first spring-damper-system, second mass) is vibrating, preferrably in resonance, the third mass substantially does not execute any vibratory movement. By this, the third mass can e.g. serve as "resting pole" and is suitable for arranging drive motors, controls and control elements thereon.

The unbalance exciter of the arrangement according to the invention, which preferably is designed as directional vibrator or as circular vibrator, by advantage forms a part of the first mass or a part of the second mass, and in the intended operation excites said mass to vibrate. With the last mentioned embodiment variant of the arrangement especially huge pulsing compressive forces can be generated.

In a further preferred embodiment of the arrangement according to the invention, the second mass according to the claims is formed by several partial masses, preferably by exactly two partial masses, which by advantage have the same weight. These partial masses in each case are coupled via an own first spring-damper-system according to the claims with the first mass to form a own first vibrating system according to the claims.

The contact surface for transferring the pulsing compressive force onto a physicalness which is provided by the first mass, preferably is the outer surface of the drum of a roller, the underside of the bottom plate of a vibratory plate, the working surface of a chiselling or drilling tool or the contact surface of the vibration plate of a road paver.

In embodiments, in which the contact surface for transferring the pulsing compressive force onto a physicalness, which contact surface is provided by the first mass, is the outer surface of the drum of a roller, it is further preferred that the second mass is formed by one or several circular weightings or comprises such weightings, which are arranged inside the drum and therein can execute a vibratory movement in a direction transverse to the longitudinal axis of the drum.

In particular in the case that the unbalance shaft of the unbalance exciter penetrates the circular weighting or the circular weightings, extremely compact arrangements according to the invention become possible.

A second aspect of the invention concerns a soil compaction device comprising an arrangement according to the first aspect of the invention, namely preferably a vibratory plate or a roller preferably having one or two vibratory excited drums.

A third aspect of the invention concerns the use of the soil compaction device according to the second aspect of the invention for the compaction of asphalt. In such usages of the devices, the advantages of the inventions especially clear become apparent.

A fourth aspect of the invention concerns a method of operating an arrangement according to the first aspect of the invention or of operating a soil compaction device according to the second aspect of the invention. According to the method, the contact surface of the first mass, e.g. the underside of the bottom plate of a vibratory plate equipped with the arrangement according to the invention or the tip of the drill of a rotary hammer drill equipped with the arrangement according to the invention, is brought into contact with a physicalness, e.g. with a ground surface to be compacted or with a wall of a building in which a hole shall be drilled. While the contact surface is in contact with the physicalness, the first vibrating system by means of the unbalance exciter is excited in such a manner that the coupling of the two masses via the first spring-damper-system is temporarily suspended, preferably in regular intervals (periodically), by a vibratory movement of the second mass in the second direction, the second mass then in the uncoupled state executes a part of its oscillation path, and the coupling of the masses via the first spring-damper-system is then, after a reversal in direction of the vibratory movement of the second mass, in particularly abruptly, re-established.

With the method according to the invention particular huge pulsing compressive forces can be introduced into the physicalness that is to be treated, and in case of the operation of soil compaction devices in contact operation (permanent ground contact) ground compaction forces can be achieved which temporarily are significantly larger than 2-times the weight of the device.

Preferrably, the contact surface of the first mass during the acting upon the physicalness is continuously held in contact with the physicalness. This variant of the method is of outstanding relevance in particular for the compaction of asphalt, since a jumping of the contact surface of the compaction device would result in a fragmenting of the mineral material at the asphalt surface, what at all costs must be avoided.

In a preferred embodiment of the method, the vibrating systems of the arrangement are in such a way excited to vibrate that the second mass vibrates in phase with the first mass, preferrably with the frequency of oscillation of the first mass or with half or a third of the frequency of oscillation of the first mass. By this, especially huge pulsing compressive forces can be generated.

In still a further preferred embodiment of the method an arrangement according to the invention is used, which comprises a third mass, and the vibrating systems of the arrangement are in such a way excited to vibrate that the third mass substantially does not execute any vibratory movement.

BRIEF DESCRIPTION OF THE DRAWINGS

Further embodiments, advantages and applications of the invention result from the dependent claims and from the now following description by means of the drawings.

DESCRIPTION OF THE PREFERRED EMBODIMENTS

Figure 1A:
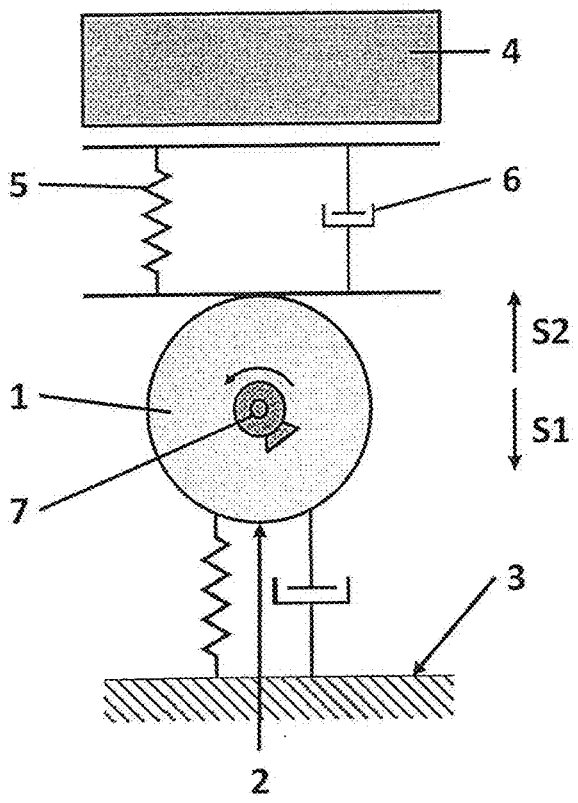
FIGS. 1*a* and 1*b* show the oscillation models of two variants of a first arrangement according to the invention.
Figure 1B:
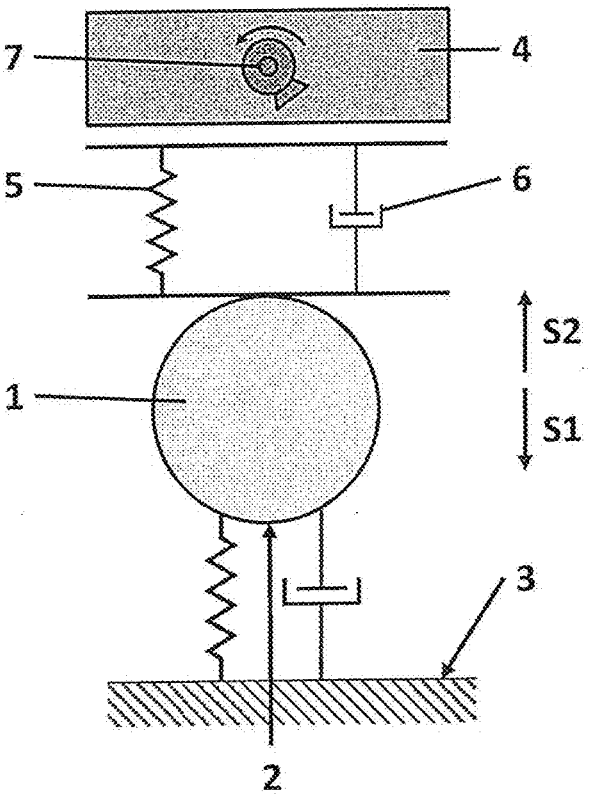

The FIGS. 1*a* and 1*b* show the oscillation models of two variants of a first arrangement according to the invention for providing a pulsing compressive force, which is a part of a vibration-excited roller for soil compaction.

As can be seen, the arrangement comprises a first mass 1, which provides a contact surface 2 in the form of the outer surface of the drum of the roller for transferring the pulsing compressive force onto the ground area 3 that is to be compacted. Further, the arrangement comprises a second mass 4, which via a spring-damper-system 5, 6 (first spring-damper-system according to the claims) is coupled with the first mass 1 to form a vibrating system 1, 4, 5, 6 (first vibrating system according to the claims).

Also the arrangement comprises an unbalance exciter 7, by means of which this vibrating system 1, 4, 5, 6 can be excited to vibrate. In the static state of the first vibrating system 1, 4, 5, 6, the second mass 4 due to its weight exerts a static force via the first spring-damper-system 5, 6 in the direction S1 (first direction according to the claims) onto the first mass 1, which direction in the present case is identical with the direction of gravity.

In that case, the first mass 1 and the second mass 4 are coupled to one another via the spring-damper-system 5, 6 in such a way that in the intended operation via this system 5, 6 no forces can be transferred from the first mass 1 in the direction S1 to the second mass 4 and no forces can be transferred from the second mass 4 to the first mass 1 in a direction S2 (second direction according to the claims), which is opposite to the direction S1.

Thus, in the present case, the second mass 4 in the static state of the system 1, 4, 5, 6 exerts a static force in the direction of gravity on the first mass 1 and the coupling is such that via the spring-damper-system 5, 6 exclusively compressive forces can be transferred between the two masses 1, 4.

The arrangement which is exemplary illustrated here is furthermore designed such that the coupling of the two masses 1, 4 via the first spring-damper-system 5, 6 during the intended operation can periodically be temporarily suspended by a vibratory movement of the second mass 4 in the direction S2, i.e. opposite the direction of gravity, the second mass then can, in the uncoupled state, execute a part of its oscillation path, and the coupling via the first spring-damper-system 5, 6 is then, following a reversal in direction of the vibratory movement of the second mass 4, re-established. In the present case, the temporary suspension of the coupling of the two masses 1, 4 via the spring-damper-system 5, 6 takes place due to a temporary decoupling of the second mass 4 from the spring-damper-system 5, 6. This coupling situation is indicated in the Figures by the distance between the spring-damper-system 5, 6 and the second mass 4.

The variants according to the FIGS. 1*a* and 1*b* merely differ from each other in that in the first mentioned variant the unbalance exciter 7 is part of the first mass 1 and in the intended operation excites it to vibrate, while the unbalance exciter in the last mentioned variant is part of the second mass 4 and in the intended operation excites this mass to vibrate. This also is the only difference between the variants denoted in the following in each case with "a" and "b" of the different embodiments of the arrangement according to the invention.

Figure 2A:
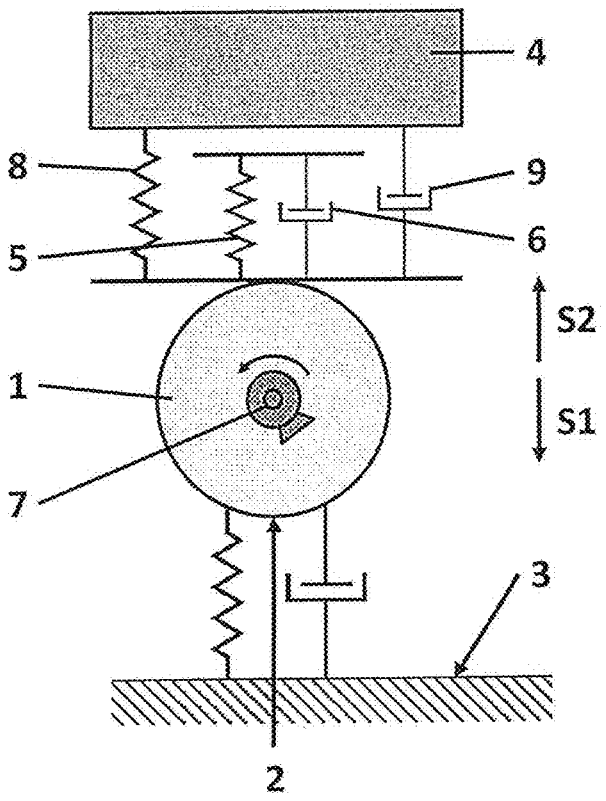
FIGS. 2*a* and 2*b* show the oscillation models of two variants of a second arrangement according to the invention.
Figure 2B:
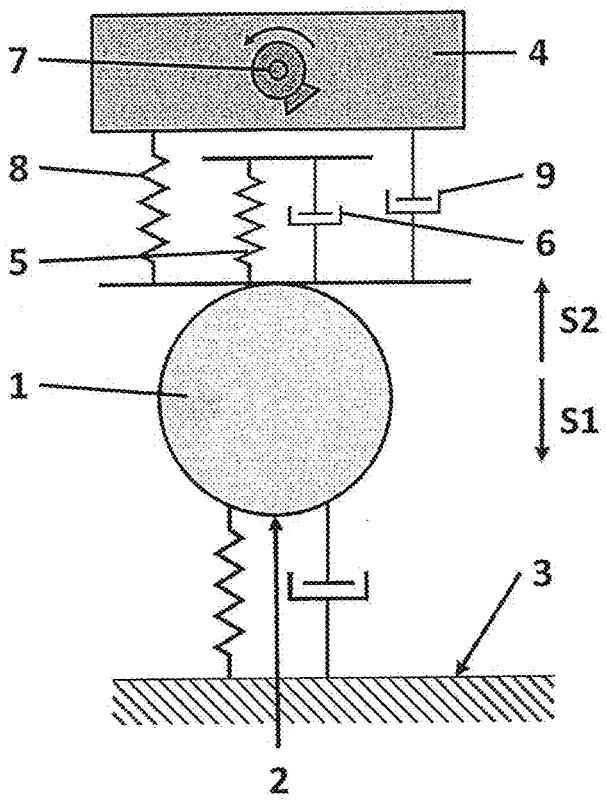

The FIGS. 2*a* and 2*b* show the oscillation models of two variants of a second arrangement according to the invention for providing a pulsing compressive force, which differs from the embodiment shown in the FIGS. 1*a* and 1*b* merely in that the first mass 1 and the second mass 4 in addition are coupled to one another via a further spring-damper-system 8, 9, the modulus of resilience and the damping of which are smaller than the modulus of resilience and the damping of the first spring-damper-system 5, 6.

Thereby, in the present case, the first mass 1 and the second mass 4 are coupled to one another via the further spring-damper-system 8, 9 in such a way that between this spring-damper-system 8, 9 and the two masses 1, 4 forces can be transferred in both direction S1, S2.

Figure 3A:
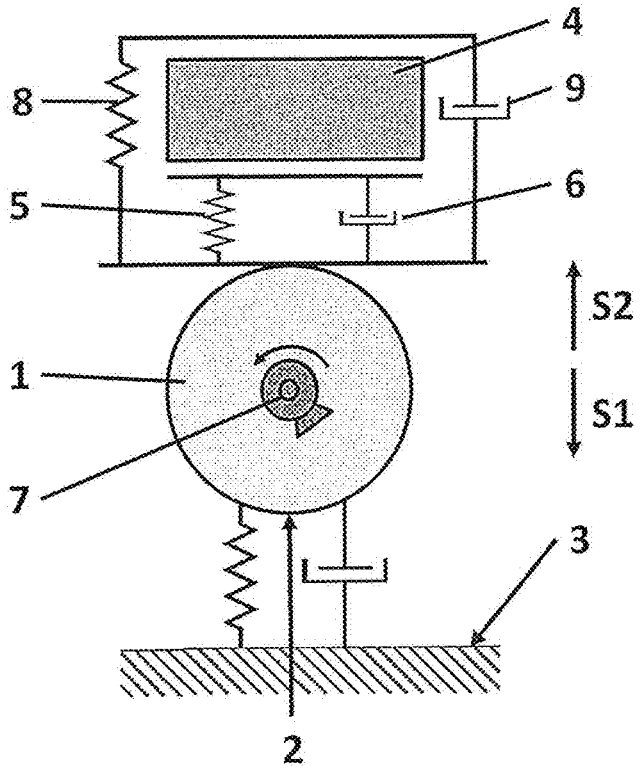
FIGS. 3*a* and 3*b* show the oscillation models of two variants of a third arrangement according to the invention.
Figure 3B:
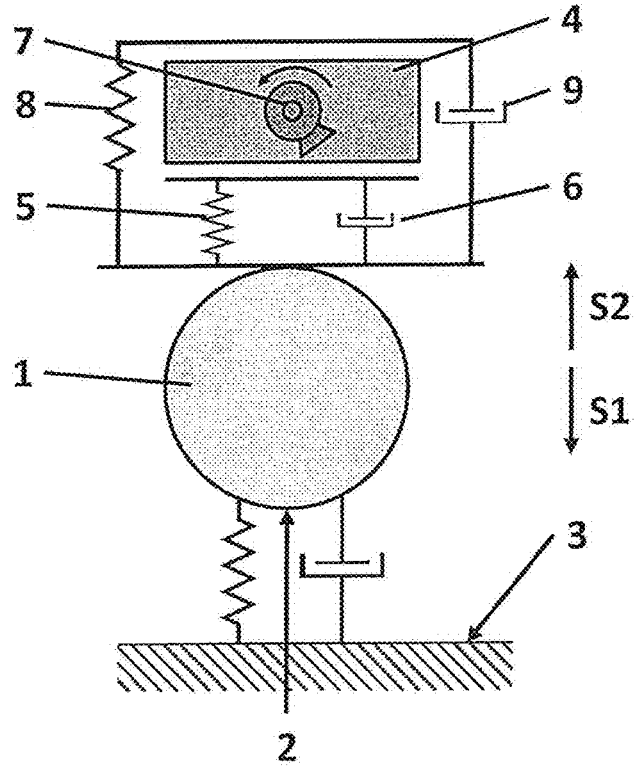

The FIGS. 3*a* and 3*b* show the oscillation models of two variants of a third arrangement according to the invention for providing a pulsing compressive force, which differs from the embodiment shown in the FIGS. 2*a* and 2*b* merely in that here the first mass 1 and the second mass 4 are coupled to one another via a further spring-damper-system 8, 9 in such a way that in the intended operation via this further spring-damper-system 8, 9 no forces can be transferred from the second mass 4 in the direction S1, i.e. in direction of gravity, to the first mass 1 and from the first mass 1 no forces can be transferred in the direction S2, i.e. opposite to the direction of gravity, to the second mass 4.

The arrangement furthermore is designed such that the coupling of the two masses 1, 4 via the further spring-damper-system 8, 9 during the intended operation can periodically be temporarily suspended by a vibratory movement of the second mass 4 in the direction S1, i.e. in direction of gravity, the second mass can then in the uncoupled state execute a part of its oscillation path, and the coupling of the two masses 1, 4 via this further spring-damper-system 8, 9 is then, following a reversal in direction of the vibratory movement of the second mass 4, i.e. in the subsequent upwards movement of the second mass 4, re-established.

The embodiments according to the FIGS. 4*a*, 4*b*, 5*a*, 5*b*, 6*a*, 6*b*, 7*a*, 7*b*, 8*a*, 8*b* and 9 of the arrangement according to the invention, which are discussed in the following, generally differ from the embodiments discussed here before according to the FIGS. 1*a*, 1*b*, 2*a*, 2*b*, 3*a* and 3*b* in that they comprise a third mass 10.

Figure 4A:
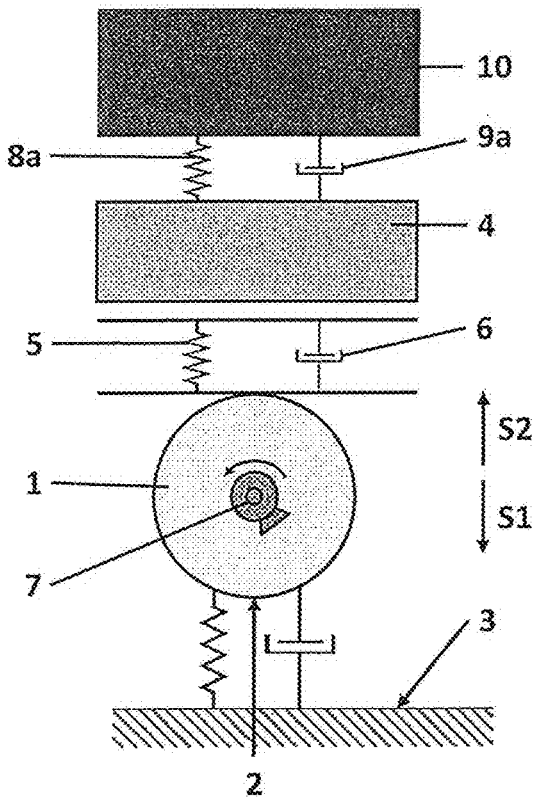
FIGS. 4*a* and 4*b* show the oscillation models of two variants of a fourth arrangement according to the invention.
Figure 4B:
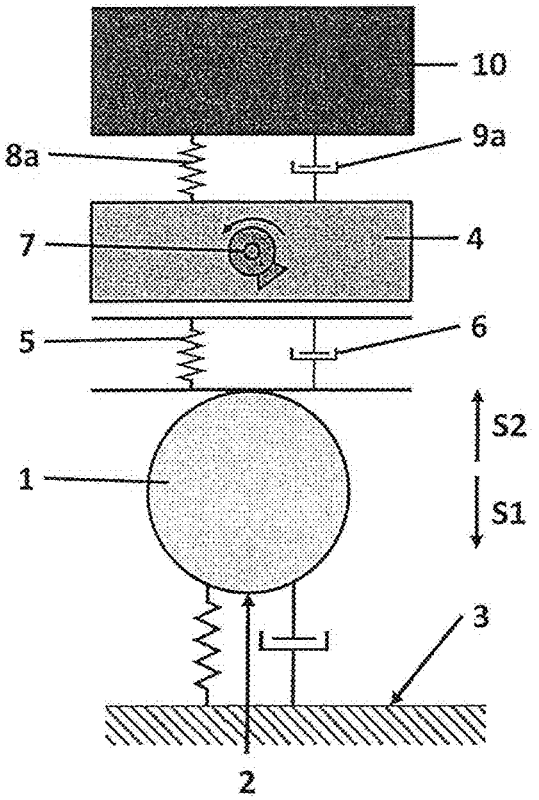

The fourth arrangement according to the invention according to the FIGS. 4*a* and 4*b* has the basic construction of the embodiment shown in the FIGS. 1*a* and 1*b*, wherein here the third mass 10 is coupled with the second mass 4 via a spring-damper-system 8*a*, 9*a* (third spring-damper-system according to the claims) to form an additional vibrating system 4, 10, 8*a*, 9*a* (third vibrating system according to the claims). In doing so, the coupling is realized in such a manner that between this spring-damper-system 8*a*, 9*a* and the two masses 10, 4 forces can be transferred in both directions S1, S2, i.e. both in direction of gravity and also opposite to the direction of gravity. Thus, via this spring-damper-system 8*a*, 9*a* both tensile and compressive forces can be transferred between the second mass 4 and the third mass 10.

Figure 5A:
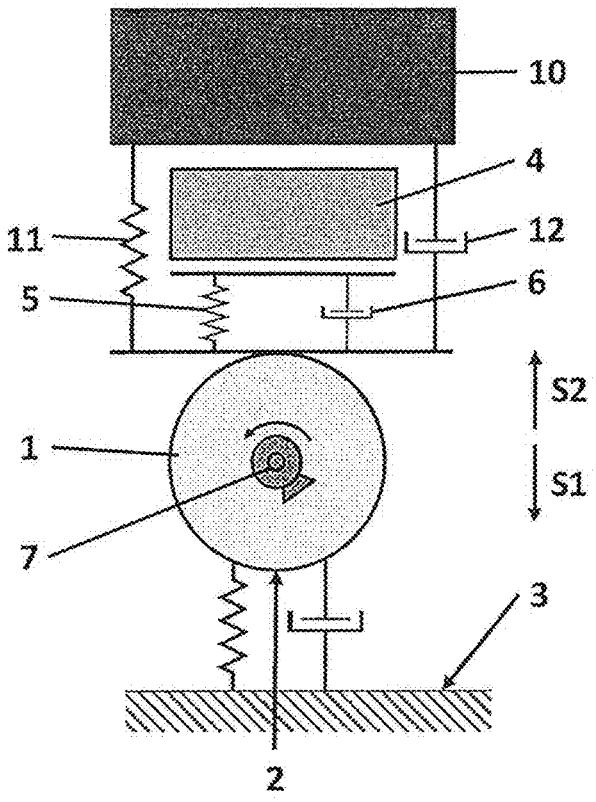
FIGS. 5*a* and 5*b* show the oscillation models of two variants of a fifth arrangement according to the invention.
Figure 5B:
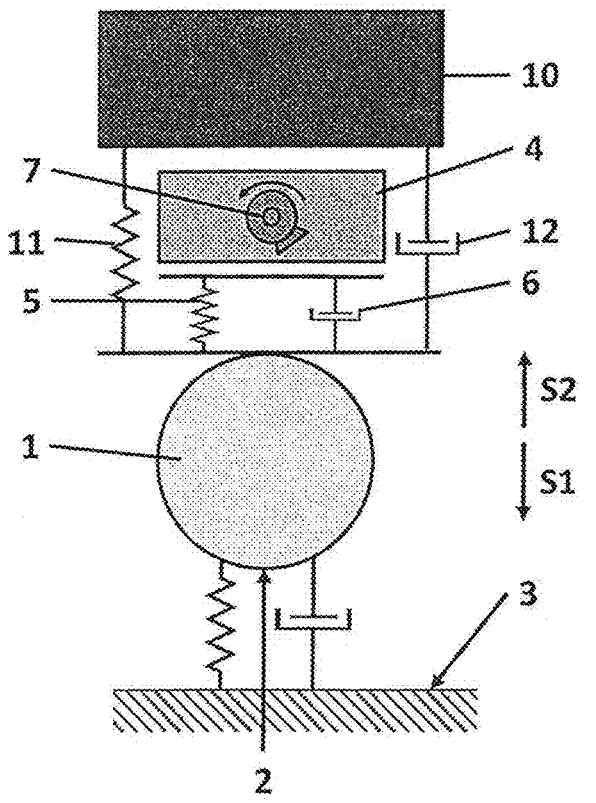

The fifth arrangement according to the invention according to the FIGS. 5*a* and 5*b* as well has the basic construction of the embodiment shown in the FIGS. 1*a* and 1*b*, wherein here the third mass 10 is coupled with the first mass 1 via a spring-damper-system 11, 12 (second spring-damper-system according to the claims) to form an additional vibrating system 1, 10, 11, 12 (second vibrating system according to the claims). In doing so, the coupling is realized in such a manner that between this spring-damper-system 11, 12 and the two masses 1, 10 forces can be transferred in both directions S1, S2, i.e. both in direction of gravity and also opposite to the direction of gravity. Thus, via this spring-damper-system 11, 12 both tensile and compressive forces can be transferred between the first mass 1 and the third mass 10.

Figure 5C:
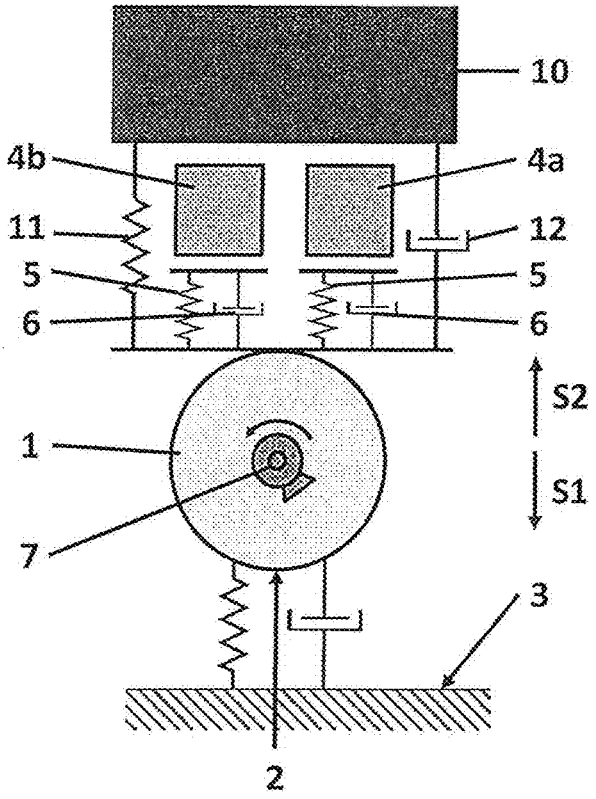
FIG. 5*c* shows the oscillation model of a subvariant of the variant shown in FIG. 5*a;*

FIG. 5*c* shows the oscillation model of a subvariant of the embodiment variant shown in FIG. 5*a*. As can be seen, this variant differs from the arrangement according to FIG. 5*a* merely in that the second mass here is splitted into two partial masses 4*a*, 4*b*, which in each case are coupled via an own spring-damper-system 5, 6 with the first mass 1 to form a vibrating system 1, 4*a*, 5, 6 and 1, 4*b*, 5, 6, respectively.

Figure 6A:
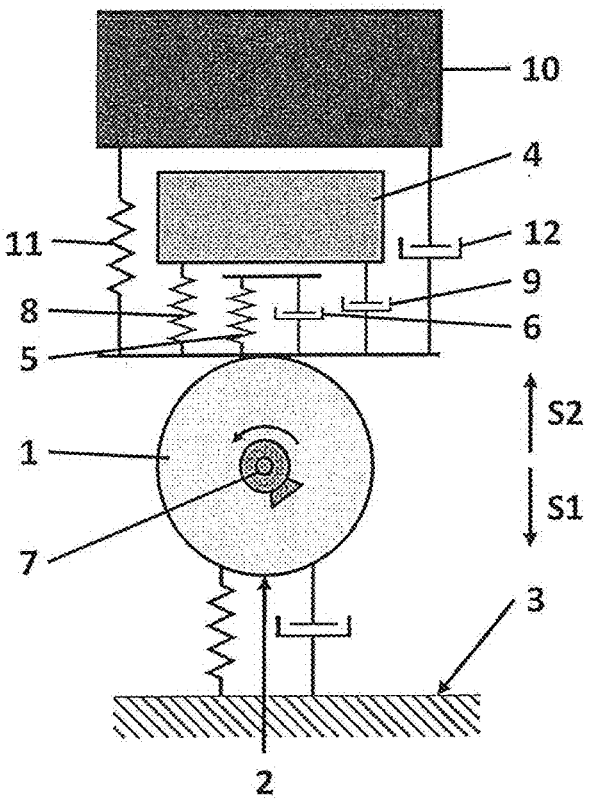
FIGS. 6*a* and 6*b* show the oscillation models of two variants of a sixth arrangement according to the invention.
Figure 6B:
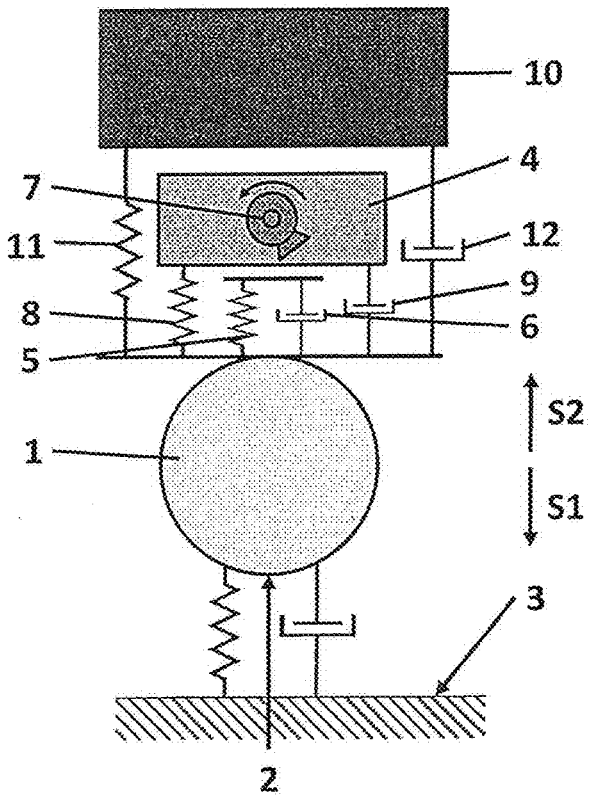

The sixth arrangement according to the invention according to the FIGS. 6*a* and 6*b* has the basic construction of the embodiment shown in the FIGS. 2*a* and 2*b*, wherein here the third mass 10 is coupled with the first mass 1 via a spring-damper-system 11, 12 (second spring-damper-system according to the claims) to form an additional vibrating system 1, 10, 11, 12 (second vibrating system according to the claims). In doing so, the coupling is realized in such a manner that between this spring-damper-system 11, 12 and the two masses 1, 10 forces can be transferred in both directions S1, S2, i.e. both in direction of gravity and also opposite to the direction of gravity. Thus, via this spring-damper-system 11, 12 both tensile and compressive forces can be transferred between the first mass 1 and the third mass 10.

Figure 7A:
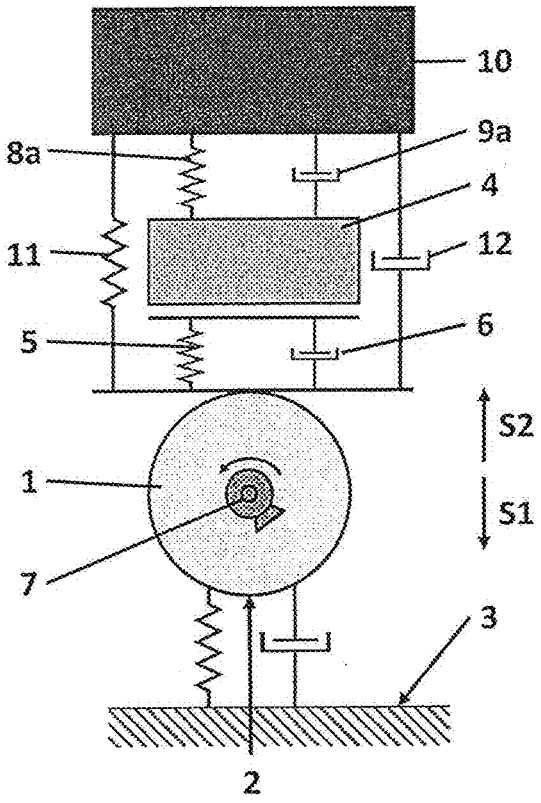
FIGS. 7*a* and 7*b* show the oscillation models of two variants of a seventh arrangement according to the invention.
Figure 7B:
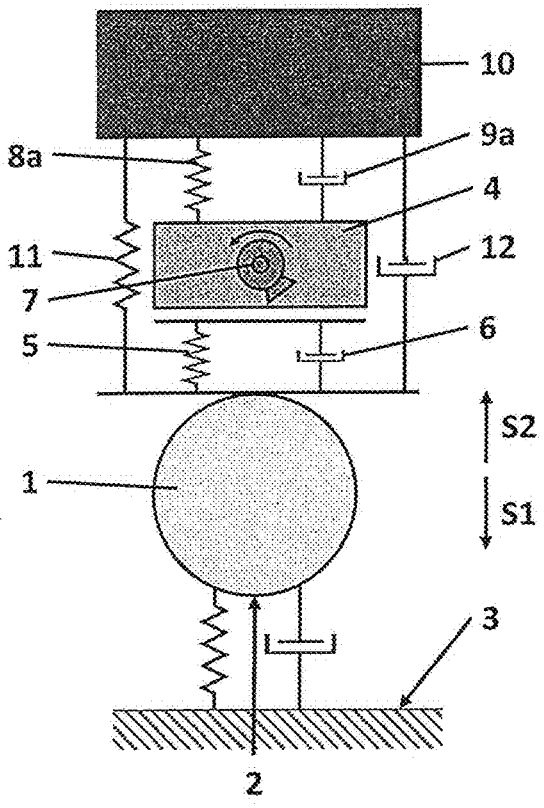

The seventh arrangement according to the invention according to the FIGS. 7*a* and 7*b* differs from the embodiment shown in the FIGS. 6*a* and 6*b* merely in that here the third mass 10 in addition, as in the embodiment shown in the FIGS. 4*a* and 4*b*, is coupled with the second mass 4 via a spring-damper-system 8*a*, 9*a* (third spring-damper-system according to the claims) to form an additional vibrating system 4, 10, 8*a*, 9*a* (third vibrating system according to the claims). The coupling is realized in such a manner that between this spring-damper-system 8*a*, 9*a* and the two masses 10, 4 forces can be transferred in both directions S1, S2, i.e. both in direction of gravity and opposite to the direction of gravity. Thus, via this spring-damper-system 8*a*, 9*a* both tensile and compressive forces can be transferred between the second mass 4 and the third mass 10.

Figure 8A:
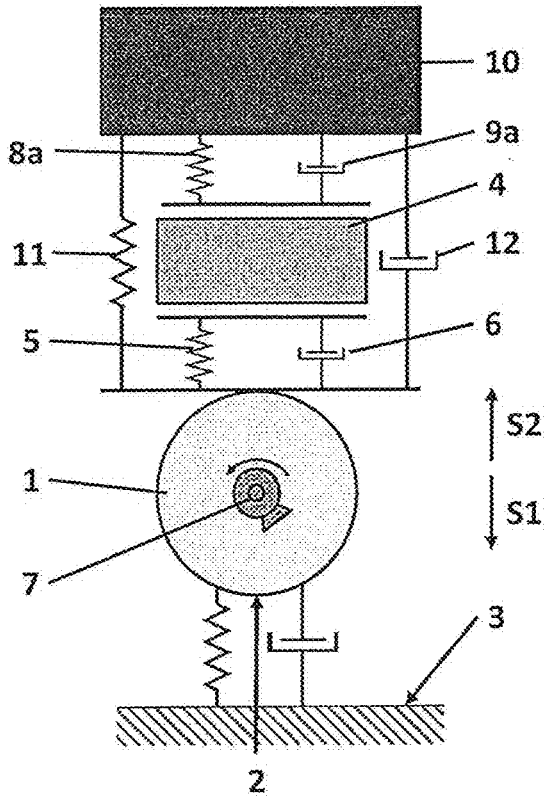
FIGS. 8*a* and 8*b* show the oscillation models of two variants of an eighth arrangement according to the invention.
Figure 8B:
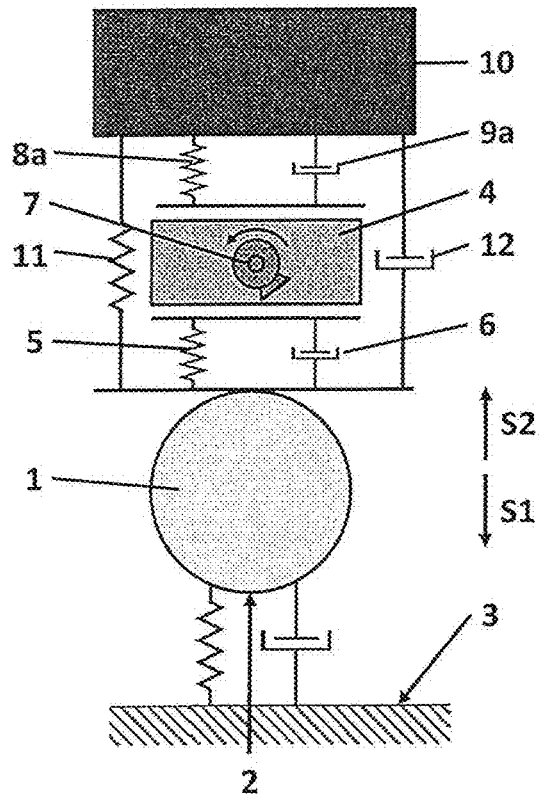

The eighth arrangement according to the invention according to the FIGS. 8*a* and 8*b* differs from the embodiment shown in the FIGS. 7*a* and 7*b* merely in that here the coupling of the third mass 10 and the second mass 4 via the spring-damper-system 8*a*, 9*a* is realized in such a way that via this spring-damper-system 8*a*, 9*a* in the intended operation no forces can be transferred from the second mass 4 in the direction S1, i.e. in the direction of gravity, to the third mass 10 and no forces can be transferred from the third mass 10 in the direction S2, i.e. in direction opposite to the direction of gravity, to the second mass 4. The arrangement furthermore is designed such that this coupling of the two masses 4, 10 via the spring-damper-system 8*a*, 9*a* during the intended operation can periodically be temporarily suspended by a vibratory movement of the second mass 4 in the direction S1, i.e. in direction of gravity, the second mass can then in the uncoupled state execute a part of its oscillation path, and the coupling of the two masses 4, 10 via the spring-damper-system 8*a*, 9*a* is then, following a reversal in direction of the vibratory movement of the second mass 4, i.e. in the subsequent movement of it in the direction S2 opposite to the direction of gravity, re-established.

Figure 9:
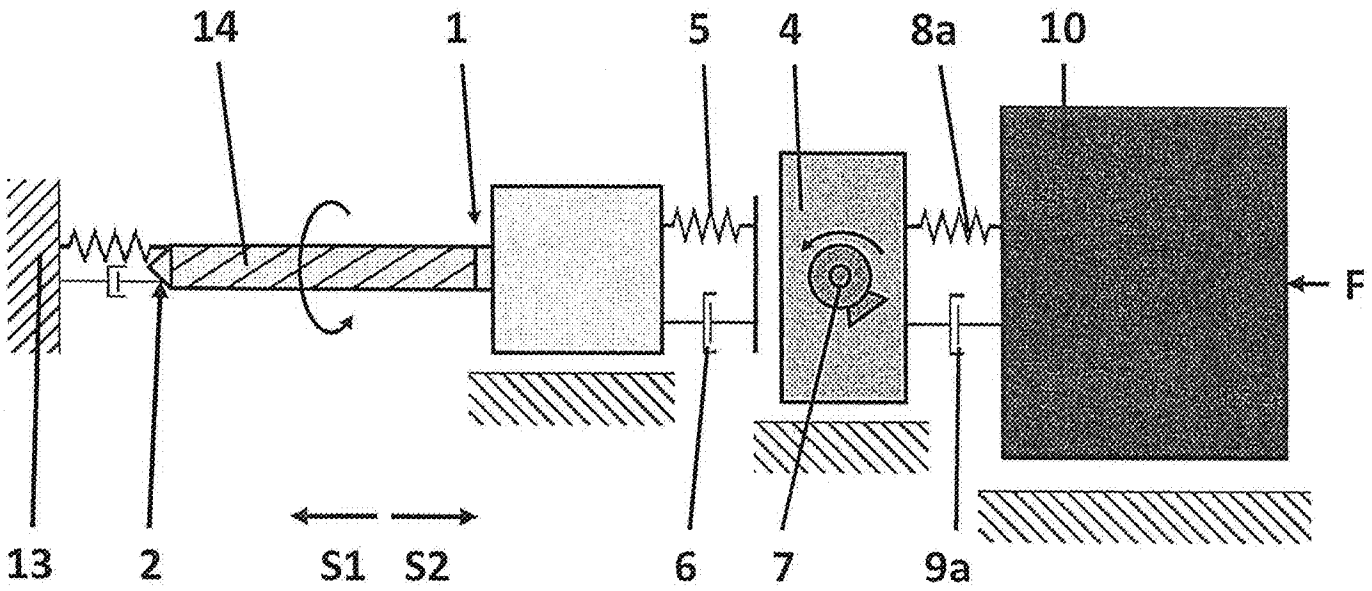
FIG. 9 shows the oscillation model of a ninth variant of the arrangement according to the invention.

FIG. 9 shows the oscillation model of a ninth variant of the arrangement according to the invention, the basic construction of which corresponds to the embodiment of the arrangement shown in FIG. 4*b*. The arrangement shown here however is part of a rotary hammer drill. Accordingly, the contact surface 2, which is provided by the first mass 1 here, consists of the tip 2 of the drill 14, by means of which a hole in a building wall 13, e.g. made of bricks, is drilled. As can be seen, the two directions S1 and S2 here run horizontally, that is why the weights of the masses 4, 10 do not generate any coupling or restoring forces, respectively, and a compressive force F charging the third mass 10 from outside and acting in direction S1, i.e. in direction towards the building wall, is necessary in order to ensure the coupling of the second mass 4 to the spring-damper-system 5, 6. This compressive force F is generated by the operator of the rotary hammer drill.

Figure 10:
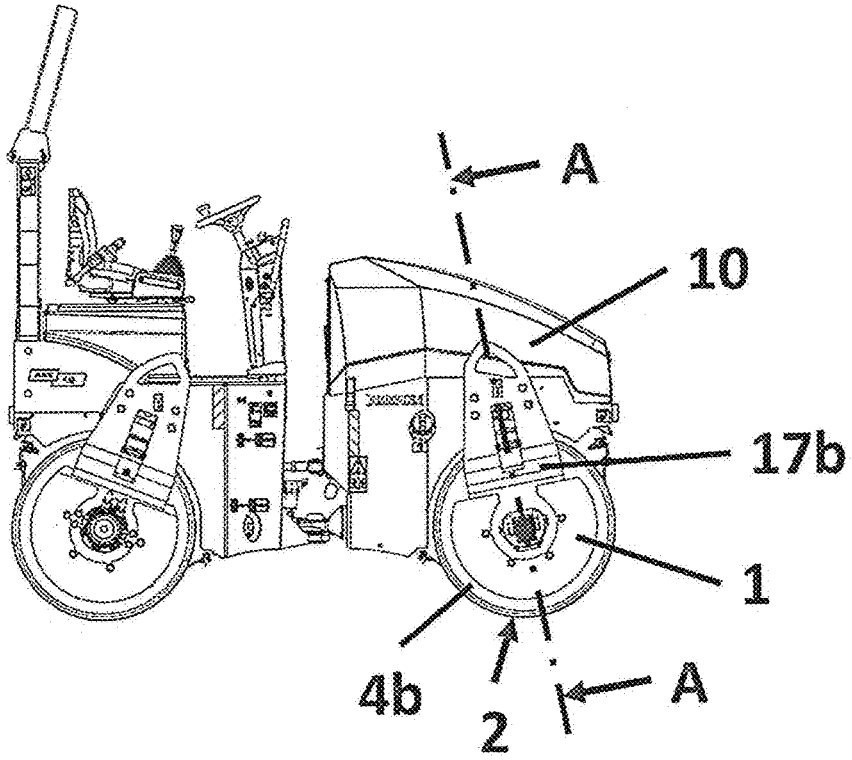
FIG. 10 shows a side view of a tandem roller according to the invention for compacting asphalt.

FIG. 10 shows a side view of a tandem roller according to the invention having an operational weight of about 4.5 tons. The roller comprises two vibration-excited drums 1 having plain outer surfaces 2, which in each case have an outer diameter of 85 cm.

Figure 11:
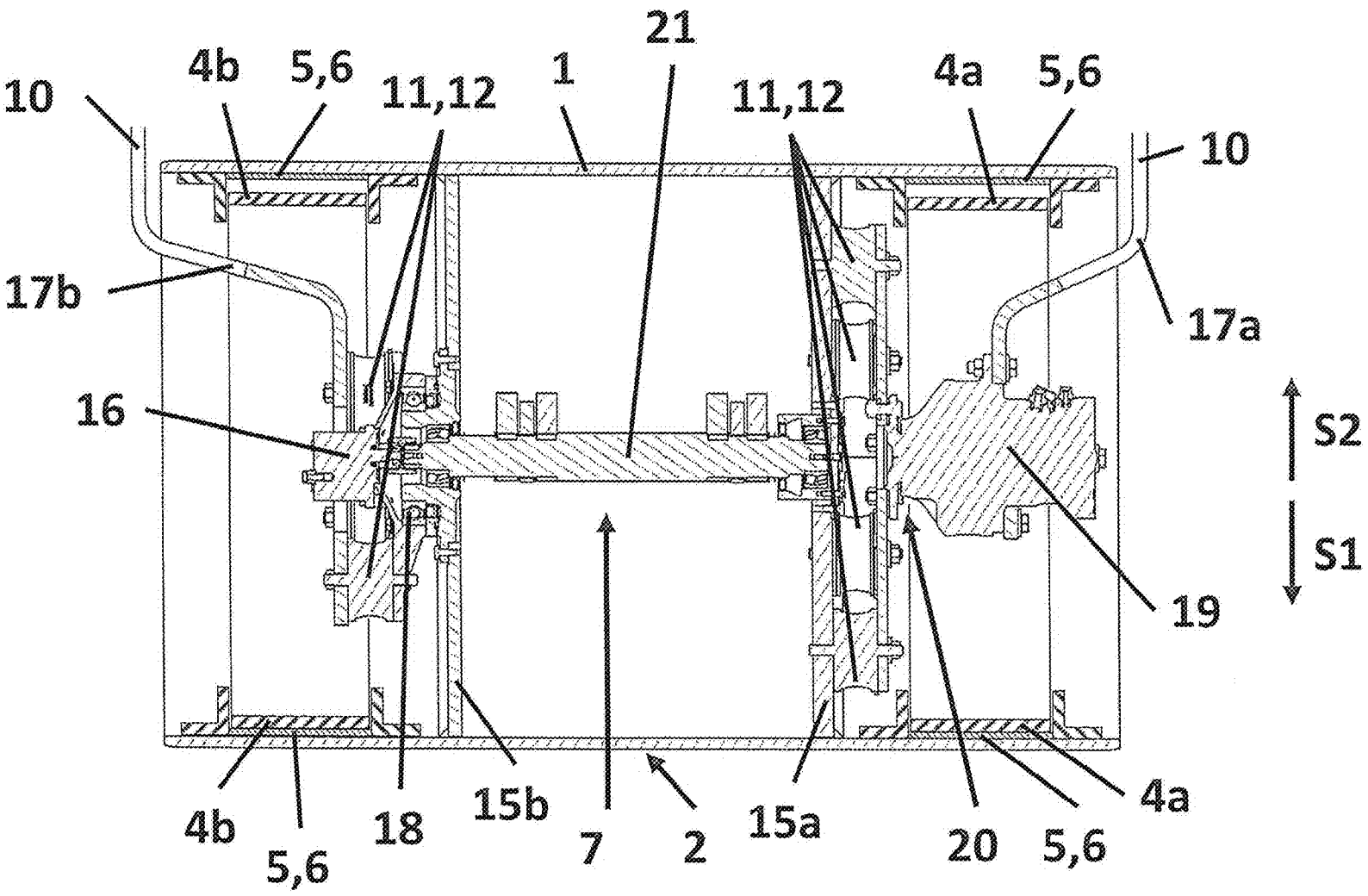
FIG. 11 shows a cut through the front drum of the tandem roller of FIG. 10 along the line A-A.

As can be seen in synopsis with FIG. 11, which shows a vertical cut through the front drum of the tandem roller along the line A-A in FIG. 10, each of the drums 1 forms, together with an unbalance exciter 7 arranged in its center, with two in each case in the area of one of the ends of the drum 1 vertically freely movably arranged additional mass rings 4*a*, 4*b* and with the roller chassis 10 which is coupled to the drum 1, an arrangement for providing a pulsing compressive force according to the invention in accordance with the oscillation model illustrated in FIG. 5*c*.

In this case, the drum 1 is in each case in the area which surrounds the additional mass rings 4*a*, 4*b*, on its inner side lined (glued) with a mat having a thickness of 1 centimeter which is made of polyurethane 5, 6 having a mass density of 1.25 g/cm3. The mats 5, 6 form in each case a first spring-damper-system according to the claims for the vibratory coupling of the respective additional mass ring 4*a* or 4*b*, respectively, to the drum 1. The additional mass rings 4*a*, 4*b* rest with their weight in direction of gravity S1 on these mats 5, 6 and by doing so are via the polyurethane mats 5, 6 one-sided coupled to the drum 1. The drum 1 with unbalance exciter 7 (first mass according to the claims) has a weight of about 750 kg. The additional mass rings 4*a*, 4*b* (second mass according to the claims) have in each case a basic weight of 100 kg and can, by means of additional weights which can be attached to them, in steps of 7.5 kg be brought in each case to a weight of 160 kg.

The unbalance exciter 7 comprises a single unbalance shaft 21 (circular vibrator) having a fixed unbalance of about 0.05 kgm, which is supported in two vertical walls 15*a*, 15*b* in the drum and can be rotated via a hydraulic motor 16.

The roller chassis 10 (third mass according to the claims) rests with a weight of about 1100 kg with two arms 17*a*, 17*b*, which laterally enter into the ends of the drum 1, on the drum 1, which relative to the chassis 10 is supported so that it can be rotated about a horizontal axis. Thereby, the roller chassis 10 via rubber vibration damper 11, 12, which form a second spring-damper-system according to the claims, is coupled to the drum 1, such that the roller chassis 10 substantially is vibrations-wise decoupled from the drum 1. On the left side of the drum 1 shown in FIG. 11, the supporting takes place via a roller bearing 18 which is rigidly connected with the drum 1, and on the right side via a supporting unit 20 that is formed by a drum drive motor 19, which supporting unit is rigidly connected with the right arm 17*a* of the roller chassis 10.

In the intended operation, the unbalance shaft 21 is rotated with the hydraulics motor 16 and then generates pulsing exciting forces with a desired exciting frequency (typically in the range between 40 Hz and 100 Hz). By this, the drum 1 is excited to vibrate accordingly and the in vertical direction freely moveable additional mass rings 4*a*, 4*b*, which due to their resting under gravity force on the polyurethane mats 5, 6 are in a vibrating manner coupled to the drum 1, also start to vibrate. In doing so, the rotary frequency of the unbalance shaft 21 (exciting frequency) and a possible weight charging of the additional mass rings 4*a*, 4*b* with additional weights is chosen such that the additional mass rings 4*a*, 4*b* periodically in a direction S2 opposite to the direction of gravity S1 temporarily take off from the polyurethane mats 5, 6, in this uncoupled state execute a part of its oscillation path in this direction S2, and then, following a reversal in direction, again travel in direction S1 and impinge on the polyurethane mats 5, 6. The outer surface 2 of the drum 1 in doing so permanently stays in contact with the ground to be compacted.

Depending on the properties (spring stiffness/damping) of the ground that is to be compacted, the rotary frequency and a possible weight charging by additional weights may vary considerably in order to achieve this operational state.

Figure 12:
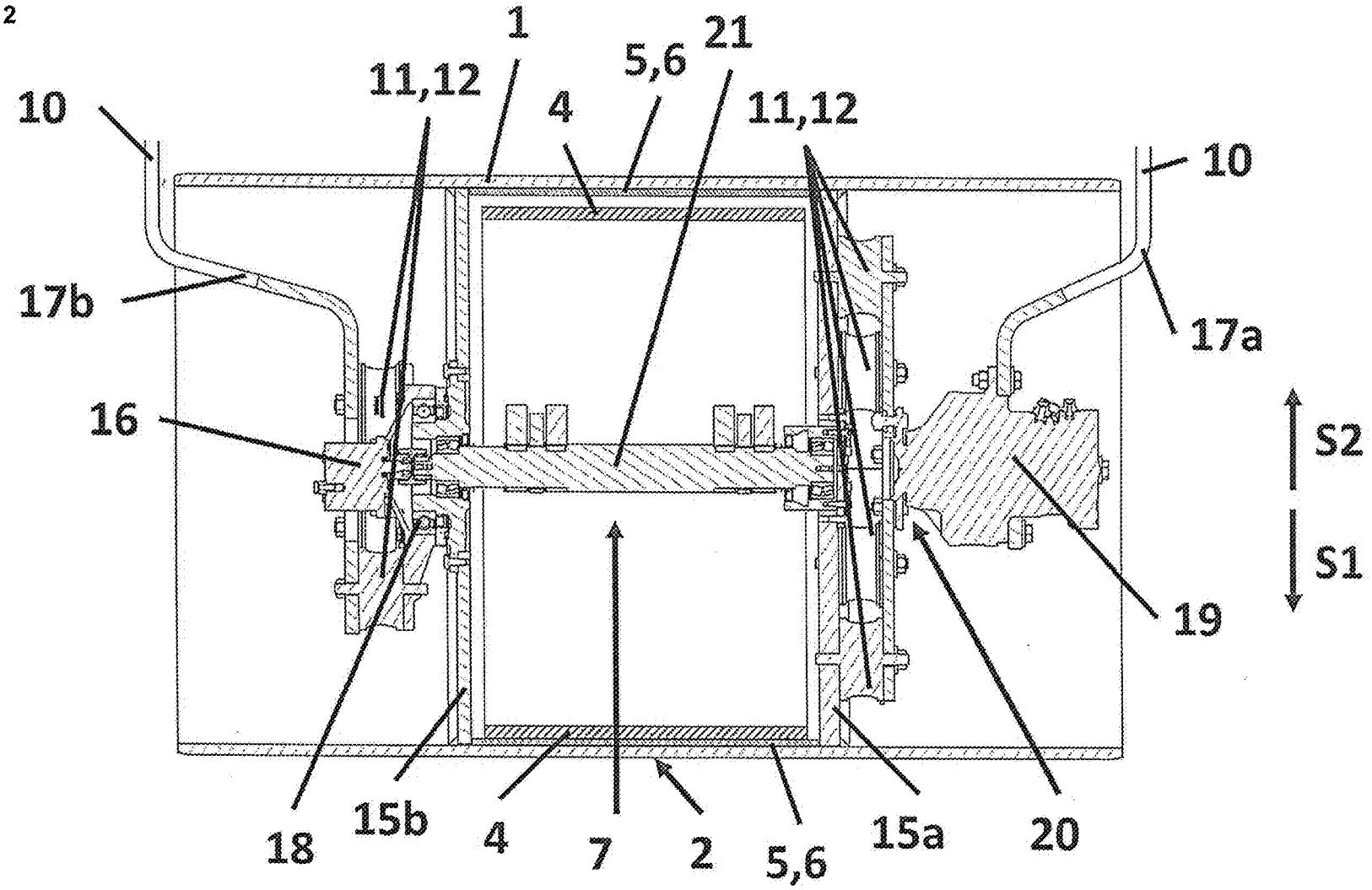
FIG. 12 shows a representation like FIG. 11 of an embodiment variant of the drum.

FIG. 12 shows a vertical cut like FIG. 11 of an embodiment variant, which differs from the one shown in FIG. 11 merely in that, instead of the two additional mass rings 4*a*, 4*b* which are arranged in the end areas of the drum 1, in the center of the drum 1 there is arranged one single additional mass ring 4 (second mass according to the claims), which inside of the drum is vertically freely moveable and is penetrated by unbalance shaft 21 of the unbalance exciter 7. The oscillation model of this embodiment variant is shown in FIG. 5*a*. Also here, the barrel of the drum 1 in the area which surrounds the additional mass ring 4, on its inner side is lined with a mat made of polyurethane 5,6, which forms a first spring-damper-system according to the claims for the vibratory coupling of the additional mass ring 4 to the drum 1. The additional mass ring rests with its weight in direction of gravity S1 on this mat 5, 6 and by doing so is via the polyurethane mat 5, 6 one-sided coupled to the drum 1.

In the intended operation, the unbalance shaft 21 is rotated with the hydraulics motor 16 and the drum 1 and the additional mass ring 4 by doing so are caused to vibrate in such a manner that the additional mass ring 4 periodically in direction S2 opposite to the direction of gravity S1 temporarily takes off from the polyurethane mat 5, 6, in this uncoupled state executes a part of its oscillation path in this direction S2, and then, following a reversal in direction, again travels in direction of gravity S1 and again impinges on the polyurethane mat 5, 6.

The outer surface 2 of the drum 1 in doing so permanently stays in contact with the ground to be compacted.

Depending on the properties (spring stiffness/damping) of the ground that is to be compacted, the rotary frequency of the unbalance shaft may vary considerably in order to achieve this operational state.

Figure 13:
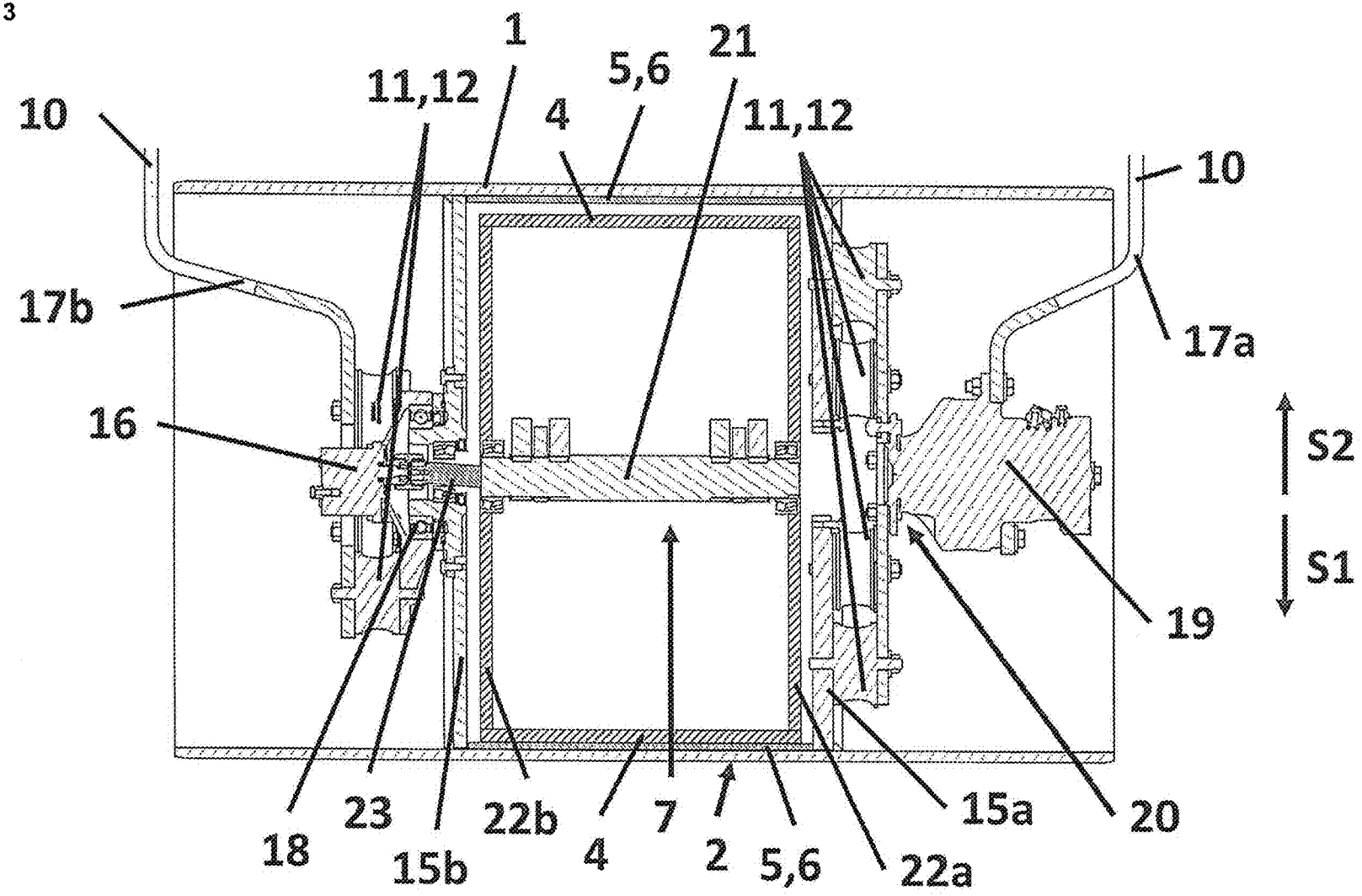
FIG. 13 shows a representation like FIG. 11 of a further embodiment variant of the drum.

FIG. 13 shows a vertical cut like FIG. 11 of a further embodiment variant, which differs from the one shown in FIG. 12 merely in that the additional mass ring 4 comprises end-sided end walls 22*a*, 22*b* and that the unbalance shaft 21 is not supported in the two vertical walls 15*a*, 15*b* in the drum, but in these end walls of the additional mass ring 4. The rotatory coupling of the unbalance shaft 21 to the hydraulic motor 16 is realized via a cardan shaft 23, such that the free vertical moveability of the additional mass ring 4 is not restrained by this coupling. The oscillation model of this embodiment variant is shown in FIG. 5*b*. As is visible, the unbalance shaft 21 together with the additional mass ring 4 here forms the second mass according to the invention.

In the intended operation the unbalance shaft 21 is rotated with the hydraulics motor 16 and the drum 1 and the additional mass ring 4 by doing so are caused to vibrate in such a manner that the additional mass ring 4 with the unbalance shaft 21 that is supported therein periodically in direction S2 opposite to the direction of gravity S1 temporarily takes off from the polyurethane mat 5, 6, in this uncoupled state executes a part of its oscillation path in this direction S2, and then, following a reversal in direction, again travels in direction of gravity S1 and again impinges on the polyurethane mat 5, 6.

The outer surface 2 of the drum 1 in doing so permanently stays in contact with the ground to be compacted.

Depending on the properties (spring stiffness/damping) of the ground that is to be compacted, the rotary frequency of the unbalance shaft 21 may vary considerably in order to achieve this operational state.

While there are described preferred embodiments of the invention in the present application it is clearly noted that the invention is not limited to them and may be carried out in other ways within the scope of the now following claims.

What is claimed is:

1. An arrangement for providing a pulsing compressive force, comprising:

a) a first mass, which provides a contact surface for transferring the pulsing compressive force onto a ground surface to be compacted or with a solid body to be machined;

b) a second mass;

c) a first spring-damper-system via which the first mass and the second mass are coupled with each other to form a first vibrating system;

d) an unbalance exciter by means of which this first vibrating system can be excited to vibrate, in particular to vibrate in resonance;

wherein in the static state of the first vibrating system the second mass exerts a static force on the first mass via the first spring-damper-system in a first direction, wherein the first mass and the second mass are coupled to one another via the first spring-damper-system in such a way that via the first spring-damper-system in the intended operation no forces can be transferred from the first mass in the first direction to the second mass and no forces can be transferred from the second mass in a second direction, which is opposite to the first direction, to the first mass, and wherein the arrangement is designed such that the coupling of the two masses via the first spring-damper-system can be temporarily suspended during the intended operation, in particular periodically, by a vibratory movement of the second mass in the second direction, the second mass can then execute a part of its oscillation path in the uncoupled state, and the coupling of the masses via the first spring-damper-system is then, following a reversal in direction of the vibratory movement of the second mass, re-established.

2. The arrangement according to claim 1, wherein the first mass and the second mass are coupled to one another via the first spring-damper-system in such a way that the second mass when vibrating in the intended operation, in particular periodically can uncouple from the first spring-damper-system through a movement in the second direction and in the uncoupled state can execute a part of its oscillation path, and then, following a reversal in direction of movement, in particular abruptly couples again to the first spring-damper-system.

3. The arrangement according to claim 1, wherein in the static state of the first vibrating system, the second mass exerts a static compressive force on the first mass via the first spring-damper-system, and wherein the first mass and the second mass are coupled to one another via the first spring-damper-system in such a way that via the first spring-damper-system exclusively compressive forces can be transferred between the two masses.

4. The arrangement according to claim 1, wherein in the static state of the first vibrating system, the second mass exerts a static tensile force on the first mass via the first spring-damper-system, and wherein the first mass and the second mass are coupled to one another via the first spring-damper-system in such a way that via the first spring-damper-system exclusively tensile forces can be transferred between the two masses.

5. The arrangement according to claim 1, wherein the static force exerted in the static state of the first vibrating system by the second mass via the first spring-damper-system on the first mass substantially runs in the direction of gravity.

6. The arrangement according to claim 1, wherein the static force exerted in the static state of the first vibrating system by the second mass via the first spring-damper-system on the first mass in part or exclusively is generated by the weight of the second mass.

7. The arrangement according to claim 1, wherein the vibrating systems are tuned or are tunable such that when in the intended operation of the arrangement the first vibrating system is vibrating, in particular is vibrating in resonance, the second mass vibrates in phase with the first mass, in particular with the frequency of oscillation of the first mass or with half or a third of the frequency of oscillation of the first mass.

8. The arrangement according to claim 1, wherein the unbalance exciter is part of the first mass and in the intended operation excites said mass to vibrate.

9. The arrangement according to claim 1, wherein the unbalance exciter is part of the second mass and in the intended operation excites said mass to vibrate.

10. The arrangement according to claim 1, wherein the unbalance axciter is designed as directional vibrator or as circular vibrator.

11. The arrangement according to claim 1, wherein the second mass is formed by several, in particular by exactly two, in particular identical partial masses, which in each case are coupled via a own first spring-damper-system with the first mass to form a own first vibrating system.

12. The arrangement according to claim 1, wherein the contact surface for transferring the pulsing compressive force onto a ground surface or solid body which is provided by the first mass is the outer surface of the drum of a roller, the underside of the bottom plate of a vibratory plate, the working surface of a chiselling or drilling tool or the contact surface of the vibration plate of a road paver.

13. The arrangement according to claim 1, wherein the contact surface for transferring the pulsing compressive force onto a ground surface or solid body which is provided by the first mass is the outer surface of the drum of a roller and wherein the second mass is formed by one or several circular weightings or comprises such, which are arranged inside the drum and therein can execute a vibratory movement in a direction transverse to the longitudinal axis of the drum.

14. The arrangement according to claim 13, wherein the circular weighting or the circular weightings is or are penetrated by the unbalance shaft of the unbalance exciter.

15. The arrangement according to claim 1, wherein the static force exerted in the static state of the first vibrating system by the second mass via the first spring-damper-system on the first mass in part or exclusively is generated by a force charged to the second mass.

16. The arrangement according to claim 15, wherein the force which is charged to the second mass is charged via one or several spring elements to the second mass.

17. The arrangement according to claim 16, wherein the one or several spring elements are connected with the first mass in such a way that in the static state of the first vibrating system via this or these spring elements a force is transferred to the first mass which acts in the second direction.

18. The arrangement according to claim 1, wherein the first mass and the second mass are coupled to one another via a further spring-damper-system, and in particular, wherein the modulus of resilience and/or the damping of the further spring-damper-system is smaller than the modulus of resilience and/or the damping of the first spring-damper-system.

19. The arrangement according to claim 18, wherein the first mass and the second mass are coupled to one another via the further spring-damper-system in such a way that between the further spring-damper-system and the two masses forces can be transferred in the first direction and in the second direction.

20. The arrangement according to claim 18, wherein the first mass and the second mass are coupled to one another via the further spring-damper-system in such a way that via the further spring-damper-system in the intended operation from the second mass no forces can be transferred in the first direction to the first mass and from the first mass no forces can be transferred in the second direction to the second mass, and wherein the arrangement is designed such that the coupling of the two masses via the further the further spring-damper-system during the intended operation can be temporarily suspended, in particular periodically, by a vibratory movement of the second mass in the first direction, the second mass can then execute a part of its oscillation path in the uncoupled state, and the coupling of the masses via the further spring-damper-system is then, following a reversal in direction of the vibratory movement of the second mass, re-established.

21. The arrangement according to claim 18, wherein the one or several spring elements are connected with the first mass in such a way that in the static state of the first vibrating system via this or these spring elements a force is transferred to the first mass which acts in the second direction, and the one or several spring elements, via which the force is charged to the second mass, are part of the further spring-damper-system.

22. The arrangement according to claim 1, wherein the arrangement comprises a third mass, which via a second spring-damper-system is coupled with the first mass to form a second vibrating system and/or which via a third spring-damper-system is coupled with the second mass to form a third vibrating system.

23. The arrangement according to claim 22, wherein the third mass and the first mass are coupled with each other via a second spring-damper-system in such a manner that between the second spring-damper-system and the two masses forces can be transferred in the first direction and in the second direction.

24. The arrangement according to claim 22, wherein the third mass and the second mass are coupled with each other via a third spring-damper-system in such a manner that between the third spring-damper-system and the two masses forces can be transferred in the first direction and in the second direction.

25. The arrangement according to claim 22, wherein the third mass and the second mass are coupled with each other via a third spring-damper-system in such a manner that via the third spring-damper-system in the intended operation no forces can be transferred from the second mass in the first direction to the third mass and no forces can be transferred from the third mass in the second direction to the second mass, and wherein the arrangement is designed such that the coupling of the two masses via the third spring-damper-system during the intended operation can be temporarily suspended, in particular periodically, by a vibratory movement of the second mass in the first direction, the second mass can then execute a part of its oscillation path in the uncoupled state, and the coupling of the masses via the third spring-damper-system is then, following a reversal in direction of the vibratory movement of the second mass, re-established.

26. The arrangement according to claim 22, wherein the vibrating systems are tuned or are tunable such that when in the intended operation of the arrangement the first vibrating system is vibrating, in particular is vibrating in resonance, the third mass substantially does not execute any vibratory movement.

27. A soil compaction device comprising an arrangement according to claim 1.

28. The soil compaction device according to claim 27, wherein it is a vibratory plate or a roller, in particular a roller having one or two vibratory-excited drums.

29. Use of the soil compaction device according to claim 27 for the compaction of asphalt.

30. A method of operating an arrangement according to claim 1, wherein the contact surface of the first mass is brought into contact with a ground surface to be compacted or with a solid body to be machined, and wherein the first vibrating system by means of the unbalance exciter is excited in such a manner to vibrate that the coupling of the two masses via the first spring-damper-system is temporarily suspended during the intended operation, in particular periodically, by a vibratory movement of the second mass in the second direction, the second mass then executes a part of its oscillation path in the uncoupled state, and the coupling of the masses via the first spring-damper-system is then, following a reversal in direction of the vibratory movement of the second mass, re-established.

31. The method according to claim 30, wherein in doing so, the contact surface of the first mass is continuously held in contact with a ground surface or a solid body to be machined.

32. The method according to claim 30, wherein the vibrating systems of the arrangement are in such a way excited to vibrate that the second mass vibrates in phase with the first mass, in particular with the frequency of oscillation of the first mass or with half or a third of the frequency of oscillation of the first mass.

33. The method according to claim 30, wherein an arrangement in which the vibrating systems are tuned or tunable is used and in doing so the vibrating systems of the arrangement are in such a way excited to vibrate that the third mass substantially does not execute any vibratory movement.

* * * * *